US007499668B2

(12) United States Patent
Honda et al.

(10) Patent No.: US 7,499,668 B2
(45) Date of Patent: Mar. 3, 2009

(54) IMAGE FORMING APPARATUS INCLUDING BELT MEMBER WITH NON-IMAGE FORMING AREA

(75) Inventors: Shin Honda, Saitama (JP); Hiroshi Nishikawa, Saitama (JP)

(73) Assignee: Fuji Xerox Co., Ltd, Tokyo (JP)

( * ) Notice: Subject to any disclaimer, the term of this patent is extended or adjusted under 35 U.S.C. 154(b) by 254 days.

(21) Appl. No.: 11/481,971

(22) Filed: Jul. 7, 2006

(65) Prior Publication Data

US 2007/0172266 A1 Jul. 26, 2007

(30) Foreign Application Priority Data

Jan. 24, 2006 (JP) ..... P2006-014551

(51) Int. Cl.
*G03G 15/01* (2006.01)

(52) U.S. Cl. ..... 399/302

(58) Field of Classification Search ..... 399/302, 399/308, 303, 313, 312
See application file for complete search history.

(56) References Cited

U.S. PATENT DOCUMENTS 6,032,006 A * 2/2000 Yanagida
6,892,034 B2 * 5/2005 Katayanagi et al.
7,349,658 B2 * 3/2008 Ogata et al. ..... 399/303
2005/0089351 A1 4/2005 Kim et al.
2005/0158086 A1 * 7/2005 Sato et al.
2007/0048033 A1 * 3/2007 Soures et al.

FOREIGN PATENT DOCUMENTS

| | | | |
|---|---|---|---|
| CN | 1612063 A | | 5/2005 |
| JP | 9-123553 A | | 5/1997 |
| JP | 11-212426 A | | 8/1999 |
| JP | 2002169383 A | * | 6/2002 |
| JP | 2005-221855 A | | 8/2005 |

OTHER PUBLICATIONS

Chinese Office Action dated Jul. 4, 2008.

* cited by examiner

*Primary Examiner*—Susan S Lee
(74) *Attorney, Agent, or Firm*—Sughrue Mion, PLLC

(57) ABSTRACT

An image forming apparatus includes: an image carrier an outer face on which a plurality of color images are formed; a plurality of roll portions; a belt member including an inner side, an outer side, and a predetermined non-image forming area. The inner side is stretched around the plurality of roll portions. The outer side includes a surface contact area for being in surface contact with a part of the outer face of the image carrier such that the plurality of color images formed on the image carrier are transferred to the surface contact area; the belt member is driven by a rotation of the image carrier and includes a predetermined non-image forming area; and the belt member is operated in a slippage prevention mode in which the belt member is moved and stopped at a slippage preventing position where the predetermined non-image forming area faces the surface contact area.

4 Claims, 3 Drawing Sheets

SLIPPAGE PREVENTING POSITION

STANDBY POSITION

SLIPPAGE PREVENTING POSITION

STANDBY POSITION

IMAGE FORMING APPARATUS INCLUDING BELT MEMBER WITH NON-IMAGE FORMING AREA

This application claims priority under 35 USC 119 from Japanese patent application No. 2006-014551, the disclosure of which is incorporated by reference herein.

BACKGROUND

1. Technical Field

The present invention relates to an image forming apparatus of the electrophotographic system, and more particularly to an improvement of an image forming apparatus in which a belt-like transferring member is driven by a drum-like image carrier.

2. Related Art

In the related art, an image forming apparatus in which a belt-like member is used as a component is known. Among image forming apparatuses of this kind, for example, there is an apparatus having: a photosensitive drum that is a drum-like image carrier that is rotated; a charger, a writer, a developer, a primary transfer device, and a cleaner that are arranged around the photosensitive drum, and comprising an intermediate transfer belt that is a belt-like member that is opposed to the photosensitive drum while being contacted therewith, and that is rotated at the same peripheral speed as the photosensitive drum. In such an image forming apparatus, the intermediate transfer belt is rotated in a predetermined direction. A position detecting sensor that optically detects a positioning marker is disposed on the intermediate transfer belt, and is formed by a reflective material disposed in an area where the positioning marker passes.

When the image forming apparatus is to form an image, during rotations of the photosensitive drum and the intermediate transfer belt, the image forming operation is started at a constant timing from detection of the positioning marker by the position detecting sensor. When the image forming operation is ended, a driving motor that rotates the intermediate transfer belt is stopped so that the intermediate transfer belt is also stopped. At this time, in order to make constant the so-called first print out time (hereinafter, referred to also as FPOT) from reception of instructions for forming the next image to completion of an output of the image, the driving motor is stopped after an elapse of a preset time after detection of the positioning marker by the position detecting sensor so that the intermediate transfer belt is always stopped at the same position.

However, since the intermediate transfer belt is stretched by plural holding rolls, there arises a possibility that an image failure such as a white band occurs in the following manner. When the intermediate transfer belt is always stopped at the same position as described above, a curl due to the holding rolls occurs over time in portions that are wound around the holding rolls.

In order to meet recent requests for cost reduction and miniaturization, an image forming apparatus of the electrophotographic system is known in that an intermediate transfer belt is driven by rotation of a photosensitive drum. In an image forming apparatus having such a configuration, the intermediate transfer belt is stretched by plural roll portions, and a part of the outer periphery of the belt is in surface contact with the photosensitive drum so as to cover the peripheral face of the photosensitive drum. The rotating force of the photosensitive drum is used as a force of driving the intermediate transfer belt by a contact frictional force of the surface-contact portion. In the image forming apparatus, since the intermediate transfer belt is in surface contact with the drum-like photosensitive member so as to cover a part of the surface of the photosensitive drum, a concave curl is formed in the intermediate transfer belt. When the concave curl portion is circularly moved to again contact with the surface (peripheral face) of the photosensitive drum, the portion acts so as to separate from the surface. In a configuration where only a countermeasure of stopping the intermediate transfer belt at various positions is taken as in the related art, therefore, slippage easily occurs between the intermediate transfer belt and the surface of the photosensitive drum, and hence a notable problem is caused by an image failure such as color misalignment.

SUMMARY

According to an aspect of the present invention, an image forming apparatus includes: an image carrier that is substantially drum shaped and that is rotatably disposed, the image carrier including an outer face on which a plurality of color images are formed; a plurality of roll portions; a belt member that is rotatably formed, the belt member including an inner side, an outer side, and a predetermined non-image forming area; wherein the inner side is stretched around the plurality of roll portions; the outer side includes a surface contact area for being in surface contact with a part of the outer face of the image carrier such that the plurality of color images formed on the image carrier are transferred to the surface contact area; the belt member is driven by a rotation of the image carrier and includes a predetermined non-image forming area; and the belt member is operated in a slippage prevention mode in which the belt member is moved and stopped at a slippage preventing position where the predetermined non-image forming area faces the surface contact area.

BRIEF DESCRIPTION OF THE DRAWINGS

Exemplary embodiments of the present invention will be described in detail based on the following figures, wherein.

DETAILED DESCRIPTION

Figure 1:
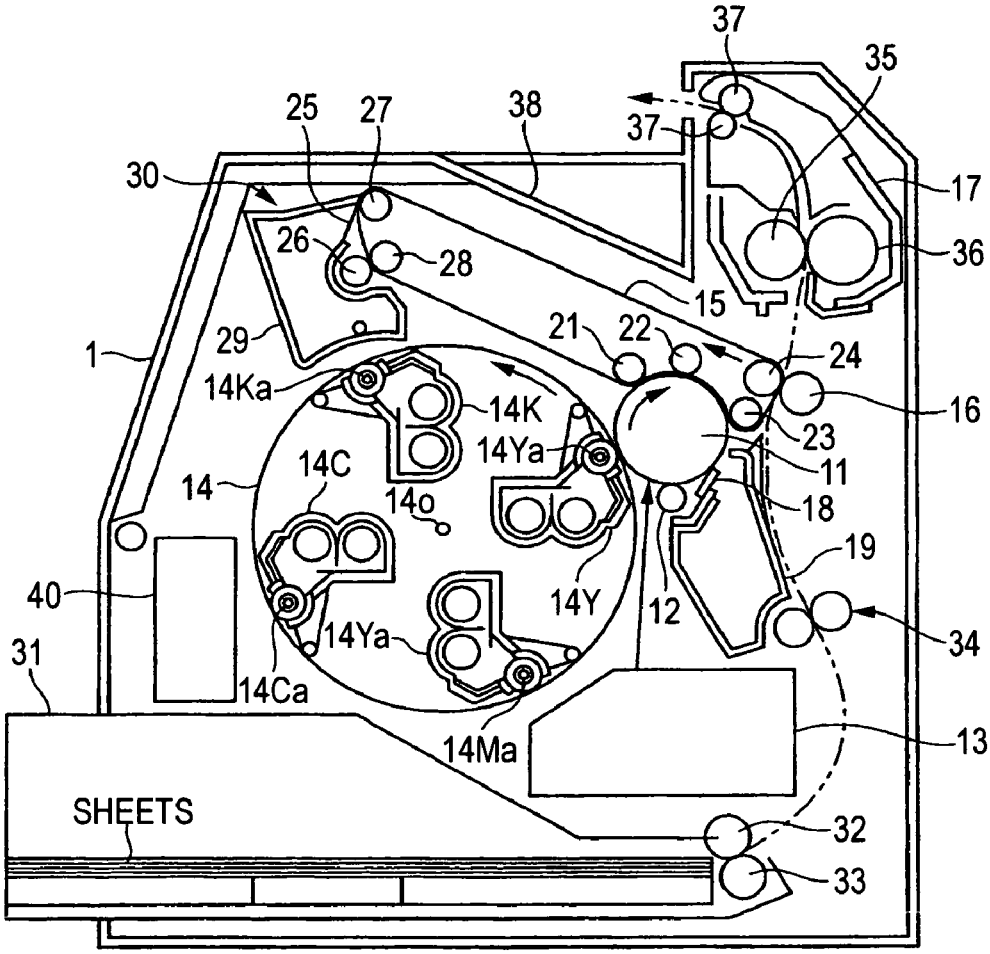
FIG. 1 is a schematic diagram showing an exemplary embodiment of the image forming apparatus of the invention.

Hereinafter, an exemplary embodiment of the invention will be described with reference to the accompanying drawings.

A schematic configuration of an image forming apparatus of the exemplary embodiment of the invention will be described with reference to FIG. 1.

The image forming apparatus of the embodiment is a digital color printer using, for example, a so-called rotary developing device. As shown in FIG. 1, the body unit 1 of the image forming apparatus comprises: a photosensitive drum 11 that is an image carrier on which an electrostatic latent image is formed and a toner image is carried; a charger 12 that gives charges to the photosensitive drum 11 by using a charging roll or the like to charge the drum; an exposing device 13 that exposes the charged photosensitive drum 11 in an exposing station by, for example, using a ROS (Raster Output Scanner) based on an image signal from an image processing apparatus (IPS) that is not shown; and a developing device 14 that develops the electrostatic latent image that has been formed on the photosensitive drum 11 by the exposing device 13, to form a toner image.

The developing device 14 in the exemplary embodiment is a rotary developing device, and comprises four developing units 14Y, 14M, 14C, 14K respectively containing toners of yellow (Y), magenta (M), cyan (C), and black (B), and in a rotary that is rotatable about a rotation shaft 14*o*, in order to form toner images of the four colors. The developing units 14Y to 14K comprise: developing rolls 14Ya to 14Ka that are developer carriers carrying a two-component developer; a tracking roll that is a positioning member for maintaining constant the distances between the developing rolls 14Ya to 14Ka and the photosensitive drum 11; and a supply auger or an admix auger that stirs the developers to be supplied to the developing rolls 14Ya to 14Ka. The developing rolls 14Ya to 14Ka are disposed on the circumference of the developing device 14. Carriers contained in the developers are attracted by a magnetic force of a magnet roll disposed inside, and a magnetic brush for the developer is formed on the surfaces of the developing rolls 14Ya to 14Ka so that a toner attracted to the carriers is transported to a developing area of the photosensitive drum 11.

In the thus configured developing device 14, the rotary is rotated steps of 90 deg. about the rotation shaft 14*o*, whereby a desired one of the developing rolls 14Ya to 14Ka of the developing units 14Y to 14K is opposed to the photosensitive drum 11. Namely, when one print image is to be output, for example, the developing units 14Y to 14K of Y, M, C, and K are opposed to the photosensitive drum 11 in this sequence, so that a full-color print image is formed. Each of the developing units 14Y to 14K is pressed along the normal line by a coil spring that is placed in the vicinity of the central axis 14*o*, and that is not shown, so that the positioning tracking roll surely butts against the photosensitive drum 11. In the photosensitive drum 11, a photosensitive layer made of an organic photosensitive material, an amorphous selenium photosensitive material, or an amorphous silicon photosensitive material is formed on the surface of a metal drum that is rotated in the direction of the arrow in the figure (in this example, in a clockwise direction). The developing device 14 is rotated in a counterclockwise direction so that movement in a tangential direction is identical with the rotation (clockwise direction) of the photosensitive drum 11.

On the downstream side of the developing device 14 on the photosensitive drum 11, arranged are: an intermediate transfer belt 15 that is an endless belt-like intermediate transfer member for temporarily holding toner images that have been developed by the developing units 14Y to 14K and formed on the photosensitive drum 11; a secondary transfer roll 16 that is a secondary transfer member for transferring the toner images that have been formed on the intermediate transfer belt 15 in a superimposed manner, onto a recording medium; a fixing device 17 that heats and presses the toner images formed on the recording medium to transfer the images onto the medium; and the like. In the periphery of the photosensitive drum 11, a photosensitive member cleaning blade 18 that scrapes off a toner (residual toner) remaining on the photosensitive drum 11 after the primary transfer onto the intermediate transfer belt 15, and a waste toner box 19 that stores and recovers the toner that has been scraped off by the photosensitive member cleaning blade 18 are disposed. A density sensor (not shown) that is a reflective sensor for measuring the densities of toners supplied from the developing units 14Y to 14K is disposed between the developing device 14 and the intermediate transfer belt 15.

In the exemplary embodiment, the intermediate transfer belt 15 is stretched between plural rolls and formed so as to extend in a track that has a substantially rectangular shape. The intermediate transfer belt contacts with (butts against) a part of the surface of the photosensitive drum 11 in a wrapping manner so that only a predetermined range is wound around the photosensitive drum 11, and is configured so that the so-called wrap transfer is enabled. Specifically, inside the intermediate transfer belt 15 in the vicinity of the photosensitive drum 11, a primary transfer roll 22 that transfers a toner image formed on the photosensitive drum 11 onto the intermediate transfer belt 15 by means of a predetermined electric field, a wrap-in roll 21 that defines the wrap position of the intermediate transfer belt 15 on the upstream side of the primary transfer roll 22, and a wrap-out roll 23 that defines the wrap position of the intermediate transfer belt 15 on the downstream side are arranged. The wrap-in roll 21 and the wrap-out roll 23 cause the intermediate transfer belt 15 to be in contact with the photosensitive drum 11 so as to cover the drum in a predetermined wrap range, and prevent pinching of the intermediate transfer belt 15 due to fluctuation of the photosensitive drum 11 or the like from occurring, thereby suppressing damage to the intermediate transfer belt 15.

In the image forming apparatus 1 of the exemplary embodiment, a driving source is not disposed in the intermediate transfer belt 15 itself, and the circulation movement of the intermediate transfer belt 15 is driven by the rotation of the photosensitive drum 11. Specifically, the intermediate transfer belt 15 in the exemplary embodiment follows the rotation of the photosensitive drum 11 by using the wrap contact with the photosensitive drum 11, and is configured to rotate (advance) in a counterclockwise direction so that the contacting portions are rotated in the same direction.

The intermediate transfer belt 15 in the embodiment can be formed by an elastic member such as chloroprene that is excellent in oil resistance and weather resistance, or EPDM that is excellent in weather resistance. In the intermediate transfer belt, a predetermined image forming area is defined for where an image that is scheduled to be transferred onto a recording sheet in a secondary transferring station is to be formed, and a non-image forming area is defined for where an image that is to be transferred onto a recording sheet is not scheduled at least during a color image forming process.

On the downstream side of the photosensitive drum 11 in the advancement direction of the intermediate transfer belt 15, the secondary transfer roll 16 that is formed so to contact with and separate from the intermediate transfer belt 15 and that also performs secondary transfer onto a recording medium by means of a predetermined electric field, and a backup roll 24 that is opposed to the secondary transfer roll 16 via the intermediate transfer belt 15 are arranged in the vicinity of a side end (in the exemplary embodiment, the right side end in the figure) of the flat and substantially rectangular track of the intermediate transfer belt 15.

On the downstream side of the secondary transferring station that is formed by the secondary transfer roll 16 and the backup roll 24, an intermediate-transfer member cleaning unit 30 serving as intermediate-transfer member cleaner is disposed that removes a residual toner on the intermediate transfer belt 15 after the secondary transfer. The intermediate-transfer member cleaning unit 30 comprises: a scraper 25 that scrapes off the toner remaining after the secondary transfer; a brush roll 26 that further scrapes off the toner remaining after the cleaning by the scraper 25; and a second toner recovery bottle 29 that recovers the toner scraped off by the scraper 25 and the brush roll 26. Inside the intermediate transfer belt 15, a cleaning backup roll 27 that assists in the cleaning by the scraper 25, and a cleaning backup roll 28 that assists in the cleaning by the brush roll 26 are arranged.

As a recording medium transporting system, a sheet-supply cassette 31 that houses various recording media such as recording sheets or OHP sheets, a feed roll 32 that feeds recording sheets from the sheet-supply cassette 31, a retard roll 33 that separates the fed recording sheets one by one, a registration roll 34 that sets (aligns) the timing of transfer (sets the position) on the recording sheet that has been fed from the sheet-supply cassette 31, and the like are arranged.

The fixing device 17 is of the heat roll type, and comprises: a heat roll 35 that heats the toner image formed on the recording sheet; a pressure roll 36 that is opposed to the heat roll 35 and that presses the recording sheet in the heating process; a pair of discharge rolls 37 that discharge the recording sheet after the fixing process to the outside of the apparatus; and a discharge tray 38 that accommodates the recording sheet discharged by the discharge rolls 37.

The image forming apparatus to that the exemplary embodiment is applied comprises: a controller 40 that controls the operations of the components; and a position detecting sensor S that is disposed adjacent to the intermediate transfer belt 15 that detects a positioning marker P formed on the intermediate transfer belt 15, and that is, for example, a reflective sensor. The position detecting sensor S reads the positioning marker P that is formed in the longitudinal direction of the intermediate transfer belt 15 to enable the position in the rotational direction of the intermediate transfer belt 15 to be detected. Namely, the apparatus is configured so that the exposing process is performed at a timing when a predetermined period elapses from the detection of the positioning marker P by the position detecting sensor S, thereby enabling the colors of Y, M, C, and K to be positioned. The toner density on the intermediate transfer belt 15 may be detected on the basis of an output of the position detecting sensor S, and the controller 40 may control the density based on a result of the detection.

Next, the image forming process that uses the image forming apparatus shown in FIG. 1 will be briefly described. In the image forming apparatus, the image forming process is started in response to an output request from a PC (personal computer) that is externally connected or from an image reading apparatus, or the like. In the case where a full color print image is to be output, the developing device 14 is first rotated so that the developing unit 14Y for yellow (Y) is opposed to the photosensitive drum 11. When a toner image of yellow is to be formed, the photosensitive drum 11 that is rotated in a clockwise direction is charged in a charging station that performs a charge forming process by the charger 12, and then exposed in the exposing station by, for example, a laser beam from the exposing device 13 on the basis of image information corresponding to yellow, thereby forming an electrostatic latent image. Then, the developing process is executed by the developing roll 14Ya. Thereafter, the yellow toner image is transferred onto a predetermined image forming area of the intermediate transfer belt 15 by the primary transfer roll 22 that is placed in the wrap contact range (hereinafter, referred to as a wrap area). At this time, the secondary transfer roll 16, the scraper 25, and the brush roll 26 are separated from the intermediate transfer belt 15 so that the toner image on the intermediate transfer belt 15 is not scraped off by them.

From the surface of the photosensitive drum 11 that has undergone the primary transfer, a residual toner is scraped off by the photosensitive member cleaning blade 18. Then, the surface is moved to the charging station of the charger 12 in order to form the next toner image. Based on a predetermined developing timing, the developing device 14 is rotated so that the developing unit 14M for magenta is opposed to the photosensitive drum 11. The exposing device 13 exposes the drum on the basis of image information of magenta to form an electrostatic latent image. From the electrostatic latent image, a toner image of magenta is formed, and then superimposed onto the intermediate transfer belt 15. Similarly, toner images of cyan and black are sequentially superimposed on the predetermined image forming area of the intermediate transfer belt 15, thereby completing the primary transfer.

On the other hand, the feed roll 32 is driven at a predetermined timing to sequentially feed recording sheets from the sheet-supply cassette 31, the sheets are separated into individual sheets by the retard roll 33, and the recording sheet then reaches the registration roll 34. The registration roll 34 is rotated in accordance with the timing of the secondary transfer in the secondary transferring station, so as to feed the recording sheet at a predetermined timing to the secondary transferring station.

The color image that has been formed by superimposing the color toners on the intermediate transfer belt 15 by the primary transfer is secondary-transferred onto the recording sheet in the secondary transferring station. Then, a fixing process is applied to the recording sheet by the fixing device 17. A residual toner on the intermediate transfer belt 15 is removed by the cleaning unit 30. In this way, the image forming process in the case where one color print image is output is ended.

In the thus configured image forming apparatus 1, when a stop state is continued for a long time, a concave curl is formed in the contact portion (wrap area) between the intermediate transfer belt 15 and the photosensitive drum 11.

In the image forming apparatus in which the intermediate transfer belt 15 is driven by rotation of the photosensitive drum 11 as described above, the concave curl portion is again circularly moved to the wrap area of the photosensitive drum 11 along rotation of the intermediate transfer belt 15. When an image is formed in the concave curl portion, the toners function as lubricating powder, and the curl portion acts so as to separate from the peripheral face of the photosensitive drum 11. Thus, slippage occurs easily between the intermediate transfer belt and the surface of the photosensitive drum 11. In the case where a color image is to be formed in this portion, particularly, toners of various colors are stacked, and hence slippage easily occurs. The driving force of the photosensitive drum 11 is therefore not stably transmitted to the intermediate transfer belt 15 and an image failure such as color misalignment causes a more notable problem. A mark image such as a patch that is formed in the non-image forming area in case of position misalignment correction or density correction is usually low in image density, and hence slippage is not problematic. The toner amount of an image that is formed in formation of a monochrome image is small as compared with that in case of color image formation. Therefore, even when such an image is formed in a curl portion, slippage is not problematic.

In the image forming apparatus of the exemplary embodiment, there is a slippage prevention mode in that the intermediate transfer belt 15 is moved and stopped at a slippage preventing position where the non-image forming area of the intermediate transfer belt 15 is disposed in the wrap area of the photosensitive drum 11. There is also a standby stop mode in that the intermediate transfer belt 15 is moved and stopped at a standby position where the distance between the positioning marker P and the position detecting sensor S is substantially constant. Depending on the situation, the both control modes are executed.

Figure 2:
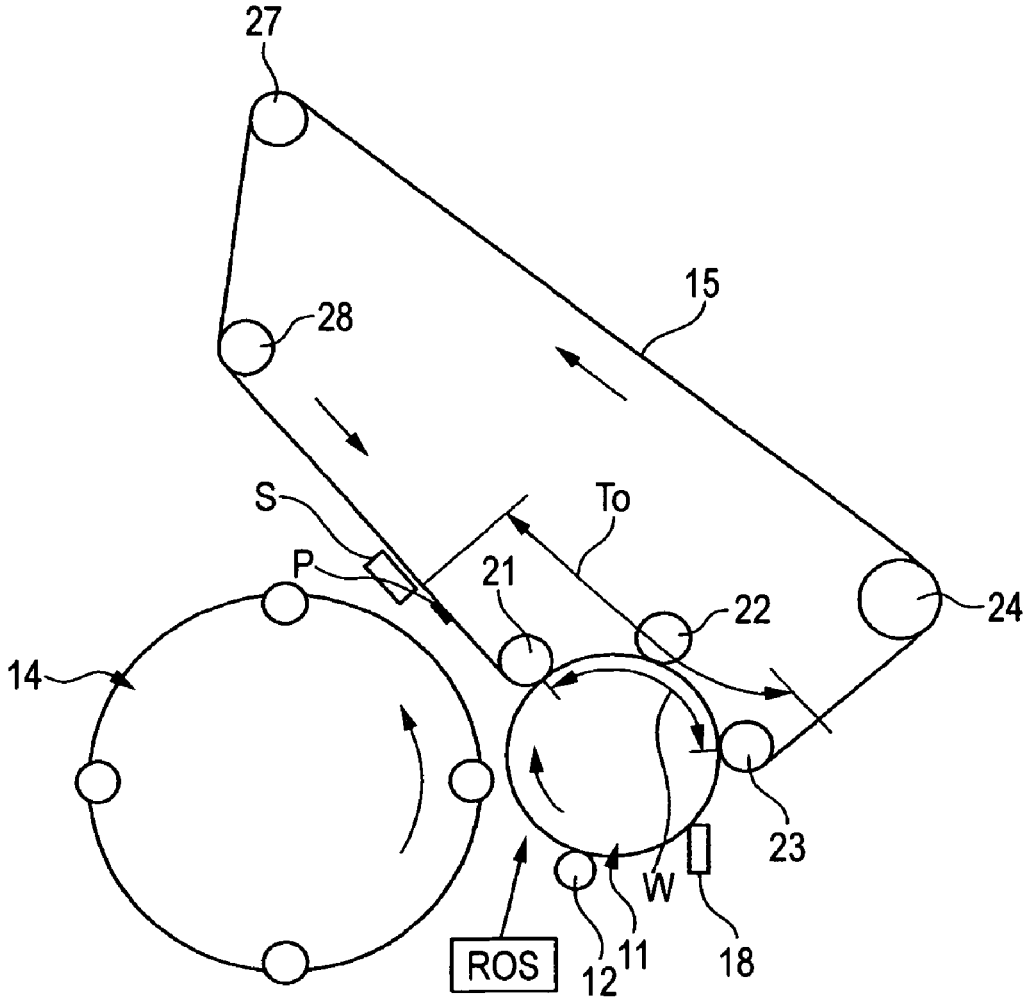
FIG. 2 is a diagram illustrating a slippage preventing position in the invention.
Figure 3:
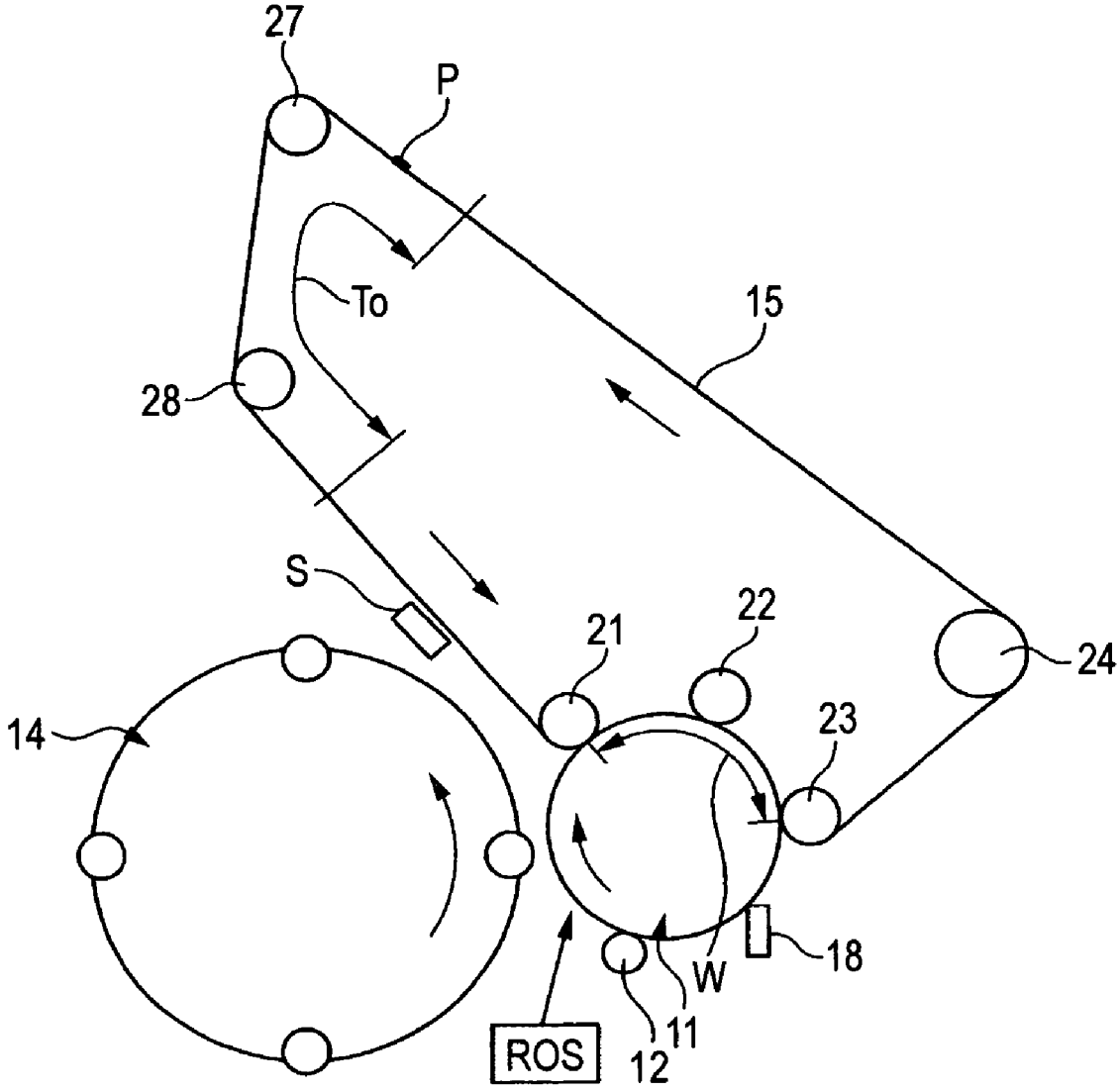
FIG. 3 is a diagram illustrating a standby position in the invention.

Next, specific contents of the slippage prevention mode and the standby stop mode in the exemplary embodiment will be described with reference to FIGS. 2 and 3. FIG. 2 is a view showing the slippage preventing position in the invention, and FIG. 3 is a view showing the standby position in the invention.

On the intermediate transfer belt 15 in the exemplary embodiment, the positioning marker P is disposed in an end of a predetermined non-image forming area on the upstream side in the advancement direction. The position detecting sensor S that detects the positioning marker P is disposed in the vicinity of the upstream side of the wrap area W that is the primary transfer area, wherein the area is between the photosensitive drum 11 and the intermediate transfer belt 15.

As shown in FIG. 2, the slippage preventing position is a position where the intermediate transfer belt 15 is moved and stopped so that a predetermined non-image forming area $T_0$ on the intermediate transfer belt 15 is positioned in the wrap area W with respect to the photosensitive drum 11. As shown in FIG. 3, the standby position is a position where the intermediate transfer belt 15 is moved and stopped so that the distance between the position detecting sensor S and the positioning marker P, that is positioned on the upstream side of the sensor and is on the intermediate transfer belt 15, has a predetermined value.

For example, the control mode is specifically executed in the following manner. In the image formation standby period after power on, the standby stop mode is executed. In a predetermined standby period that elapses until rated operations of the image forming apparatus are enabled (for example, the rising period of the fixing device 17), the intermediate transfer belt 15 is moved and stopped at the standby position shown in FIG. 3.

Accordingly, when instructions for image formation are given after completion of the standby state, image formation can be performed without adding an extra standby time and the FPOT can be maintained constant.

By contrast, when a state where the intermediate transfer belt 15 is stopped at the standby position is continued for a predetermined period (for example, about 15 minutes after power on), the slippage prevention mode is continuously executed, and the intermediate transfer belt 15 is moved and stopped at the slippage preventing position shown in FIG. 2.

In the case where the stop state of the intermediate transfer belt 15 is continued during a period when the formation of a curl is expected, the slippage prevention mode is executed, and the intermediate transfer belt 15 is moved and stopped at the slippage preventing position. In the successive image formation, therefore, the concave curl portion that is formed in the wrap area W is configured as the non-image forming area $T_0$. At least during a color image forming process, consequently, the toner of the image does not adhere to the curl portion, and it is possible to prevent slippage of the intermediate transfer belt 15 due to interposition of a toner from occurring. The stable transmission of the rotating force can effectively prevent an image failure from occurring.

In the case where instructions for image formation are given after movement is stopped at the slippage preventing position, the standby stop mode is again executed. During a predetermined standby period (for example, the wake-up period of the fixing device 17), the intermediate transfer belt 15 is again moved from the slippage preventing position and stopped at the standby position to prepare for the next image information.

According to the thus configured image forming apparatus of the invention, when an image is to be formed, the standby stop mode is executed during a predetermined standby period, and the intermediate transfer belt 15 is moved and stopped at a predetermined standby position. Therefore, an unnecessary waiting time is not added after the predetermined standby period, and the value of the FPOT can be maintained at a constant small value without affecting the user operability and the apparatus performance such as the operation time. During a predetermined standby period in the image formation, the positioning marker P is stopped at the standby position that is always separated from the position detecting sensor S by the predetermined distance, thereby enabling position detection by using the single positioning marker P. The reduction of the number of positioning markers P can contribute the cost reduction.

In the exemplary embodiment, the control modes (the standby stop mode and the slippage prevention mode) after the turning-on of the power source (the apparatus power source is turned on) have been described. The invention is not restricted to such control modes after power on, and may be applied also to the power source turning-off period when a long-term stop is expected.

In the power source turning-off period, for example, the apparatus power source may shut down after the slippage prevention mode is executed and the intermediate transfer belt 15 is moved to the slippage preventing position, so slippage due to occurrence of a curl from a long-term stop is prevented from occurring.

Alternatively, at shipment, the intermediate transfer belt 15 may be set and placed so that the non-image forming area $T_0$ of the intermediate transfer belt 15 is formed as the wrap area W.

In the case where the intermediate transfer belt 15 is set and placed in this way at shipment, even when a concave curl is formed during transportation after shipment or installation, an image is not formed on the curl portion in an image forming process after installation of the apparatus. Therefore, slippage of the intermediate transfer belt 15 can be prevented from occurring, and an image of high quality can be stably formed.

Also in a replacement unit in which the photosensitive drum 11 and the intermediate transfer belt 15 are integrated with each other in order to improve the maintainability, the intermediate transfer belt 15 may be set and placed so that the non-image forming area $T_0$ of the intermediate transfer belt 15 in the replacement unit is formed as the wrap area W. Thus, slippage of the intermediate transfer belt 15 can be prevented from occurring in an image forming process after the unit replacement, and stable image formation is enabled.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that is substantially drum shaped and that is rotatably disposed, the image carrier including an outer face on which a plurality of color images are formed;

a plurality of roll portions;

a belt member that is rotatably formed, the belt member including an inner side, an outer side, and a predetermined non-image forming area;

wherein the inner side is stretched around the plurality of roll portions;

the outer side includes a surface contact area for being in surface contact with a part of the outer face of the image carrier such that the plurality of color images formed on the image carrier are transferred to the surface contact area;

the belt member is driven by a rotation of the image carrier and includes a predetermined non-image forming area;

the belt member is operated in a slippage prevention mode in which the belt member is moved and stopped at a slippage preventing position where the predetermined non-image forming area faces the surface contact area; and a position detecting sensor that detects a position of a positioning marker that is placed on the belt member;

wherein the image forming apparatus has a standby stop mode in which the belt member is moved and stopped at a standby position and the positioning marker and the position detecting sensor are separated from each other by a predetermined distance; and the standby stop mode is executed during an image formation standby period, and the slippage prevention mode is executed when a predetermined period of time has elapsed from the image formation standby period.

2. The image forming apparatus according to claim 1, wherein the slippage prevention mode is executed when a power source of the image forming apparatus is turned off, and the standby stop mode is executed when the power source of the image forming apparatus is turned on.

3. The image forming apparatus according to claim 1, wherein the belt member is set and placed in the slippage preventing position during shipment.

4. The image forming apparatus according to claim 1, wherein the image carrier and the belt member form a single unit, and the belt member of the single unit is set and placed in the slippage preventing position during shipment.

* * * * *